United States Patent [19]

Ballin

[11] 4,189,880

[45] Feb. 26, 1980

[54] COMBINATION MOUNTING FRAME AND FILM FOR A WINDOW

[76] Inventor: Gene Ballin, P.O. Box 403, Locust Valley, N.Y. 11560

[21] Appl. No.: 915,976

[22] Filed: Jun. 16, 1978

[51] Int. Cl.[2] ..... E06B 3/26

[52] U.S. Cl. ..... 52/202; 52/222; 52/824; 160/380; 160/392

[58] Field of Search ..... 52/202, 203, 222, 824; 160/380, 392

[56] References Cited

U.S. PATENT DOCUMENTS

| | | | |
|---|---|---|---|
| 1,201,338 | 10/1916 | Orr | 160/394 |
| 2,526,912 | 10/1950 | Swanson | 160/392 X |
| 3,058,518 | 10/1962 | Housman | 160/381 X |
| 3,068,939 | 12/1962 | Commisso | 160/392 |
| 3,143,165 | 8/1964 | Lewis et al. | 160/380 X |
| 3,175,603 | 3/1965 | Tonnon | 52/203 X |

FOREIGN PATENT DOCUMENTS

| | | | |
|---|---|---|---|
| 1355914 | 2/1964 | France | 160/392 |
| 910194 | 11/1962 | United Kingdom | 52/222 |

*Primary Examiner*—Alfred C. Perham
*Attorney, Agent, or Firm*—Bauer & Amer

[57] ABSTRACT

The within improvements are applicable for window construction kits of the type used for providing storm, screen, sun-block, and/or tinted window coverings wherein, as understood, an appropriate film, such as plastic or the like, is attached by a so-called spline about its peripheral edges within a supporting frame. Among other improvements, the disclosure contemplates an optimum T-shape in the spline which provides an attached, conveniently gripped flat surface to the spline to facilitate its film-stretching entrance into said frame, to more readily place the spline into and remove it from its attached connection to said frame, as well as contributing to an enhanced appearance in the window and providing a dust cover thereto. The within disclosure also contemplates an adhesive system to facilitate attachment of the frame to a variety of surfaces.

6 Claims, 7 Drawing Figures

COMBINATION MOUNTING FRAME AND FILM FOR A WINDOW

The present invention relates generally to improvements for a construction kit for what is intended primarily as a storm window, although also applicable for constructing a window screen, and for a supporting frame for a web having a sun-blocking or tinting function and other such end uses, wherein the improvements, more particularly, greatly facilitate the mounting of the web, be it plastic or otherwise, in its cooperating supporting frame, significantly enhance the appearance of the resulting structure providing the storm or screen window hereof, as well as contribute to other noteworthy advantages and benefits.

With the coming of the energy crisis there has developed a great need for an inexpensive, effective means for providing greater window insulation. An apt solution is the use of flexible film such as vinyl, polyethylene or polyester to cover the window, but as may be readily surmised, this requires the use of a support frame to which the peripheral edge of the film must be effectively engaged so that it is held in a taut, wrinkle-free condition in spanning relation over the window. The present techniques for engaging the peripheral edge of an appropriate selected film to its support frame are not entirely satisfactory in that some of such techniques are inherently time consuming and tedious to implement, some not only fail to place the film in a taut, wrinkle-free condition but actually contribute to the manifestation of wrinkles during attachment to the support frame, while still other prior art techniques produce a combination frame and film construction that has an undesirable commercial appearance in that the selvage of the film, i.e. the portion of the film extending beyond the line of attachment to the frame, remains as a difficult-to-remove portion of the construction which has an unsightly, wrinkled appearance. Such known prior art window kits of the type involved herein also are difficult to mount in surrounding relation about the window unless the attachment surface of the construction material of the window is of a specified material, is exceptionally smooth, and has other such requirements which often is not the case.

A further complication is an inherent consequence of the fact that machinery or any tools of any degree of specialized nature to facilitate in the attachment of the film to its supporting frame are, of course, not available since what is contemplated is a "do-it-yourself", rather than a factory-assembled product. As understood, such kit usually consists of a supply length of a mounting strip which is readily cut-to-size, and includes a cooperating so-called spline, usually an elastomeric extrusion, that is circular in cross-section. Assembly of the kit contemplates placing the peripheral edge of the film over the mounting strip and pressing the spline into the strip, thereby frictionally engaging the film to the walls bounding the strip. In the assembly operation as just generally described, it should therefore be readily appreciated that it is especially important that the frame components contribute to the film, usually a plastic sheet, being effectively engaged to its supporting frame and in assuming a taut, wrinkle-free condition. Some frames for these kits of the type noted, however, merely frictionally engage the sheet, and totally fail to apply stretching forces to same as might effectively prevent wrinkles or other handling difficulties that frequently arise during the assembly of the plastic sheet to the frame. It has been totally unrecognized, in fact, that the prior art assembly procedure for mounting the plastic sheet in its supporting frame applies wrinkle-producing forces on the plastic sheet that must be neutralized, and thus underlying the present invention is, at least partially, the recognition of obviating these counter-productive forces.

Broadly, it is an object of the present invention to provide an improved construction kit for a storm window or similar end product overcoming the foregoing and other shortcomings of the prior art. Specifically, it is an object to provide an improved spline or film-engaging member which is constructed so that it is more readily handled, particularly during the assembly of the kit, as well as, of course, during disassembly thereof.

Another object is to provide an improved window construction kit, of the type above generally described, having a noteworthy neat and commercially acceptable appearance.

A still further object is to embody in the within improved kit a capability of being readily mounted in surrounding relation about its cooperating dwelling window irrespective of the construction material and condition of the frame which mounts the window sash.

Further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 4:
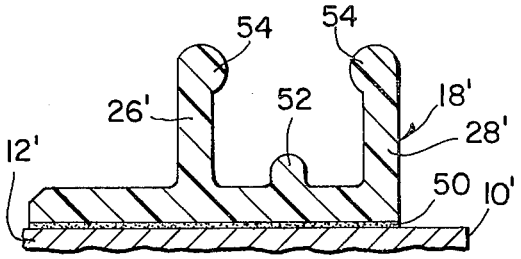
Figure 5A:
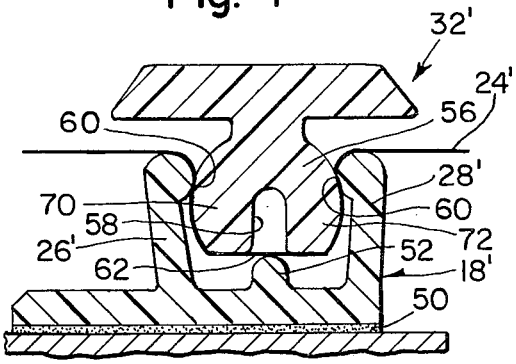
Figure 5B:
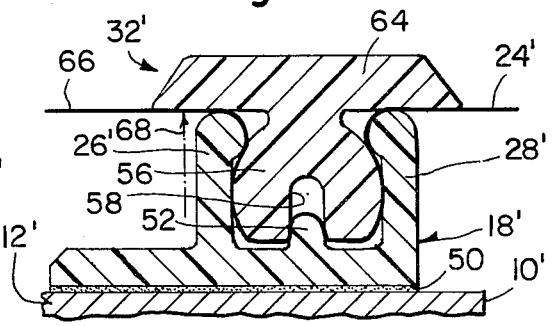
Figure 3:
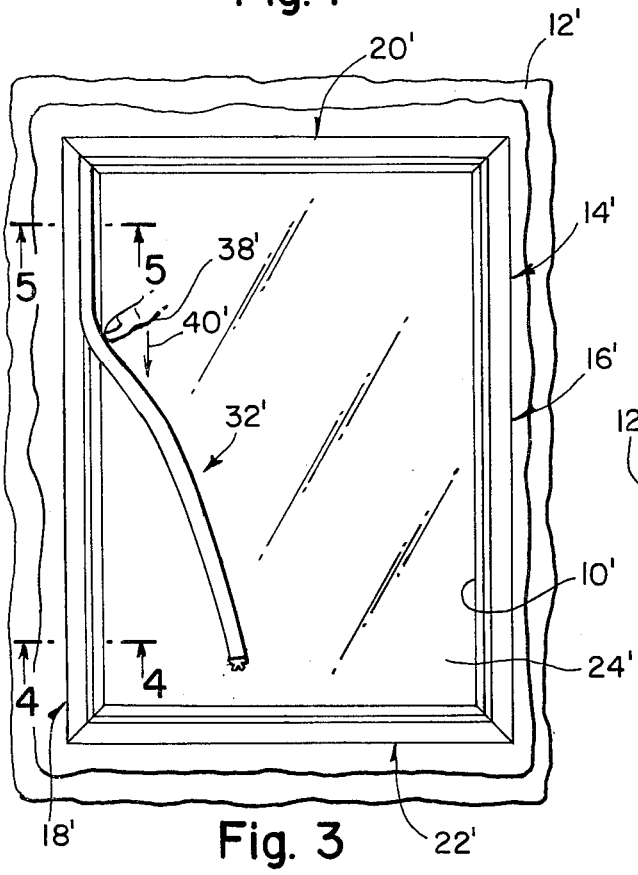
Figure 6:
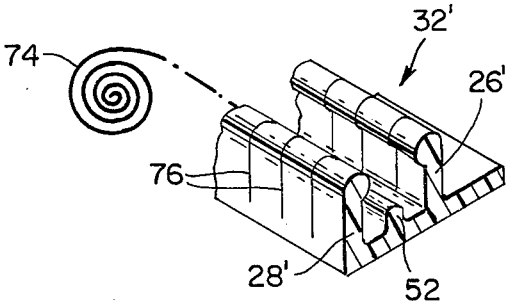

Remaining FIGS. 3–6 are related to a preferred embodiment of the improved inventive combination mounting frame and plastic sheet hereof. More particularly, FIG. 3, like FIG. 2, is a front elevational view of the mounting frame and of its cooperating plastic sheet which provide noteworthy advantages and improvements over the prior art;

FIG. 4 is an enlarged scale elevational view, in section taken on line 4—4 of FIG. 3, illustrating the structural details of the mounting strip which define a channel in which the plastic sheet is inserted during its mounting in taut condition over the window;

FIGS. 5A and 5B are related figures, both being side elevational views in section as taken along line 5—5 of FIG. 3. FIG. 5A illustrates the position of a sheet-engaging member in partial insertion within said channel of FIG. 4, whereas FIG. 5B illustrates the fully inserted position thereof; and Remaining FIG. 6 is a perspective view of another embodiment of the mounting strip of FIG. 4, said embodiment including structural features embodying the strip with a capability of being provided with a rolled, compact storage condition, such condition being illustrated diagrammatically in FIG. 6.

Figure 1:
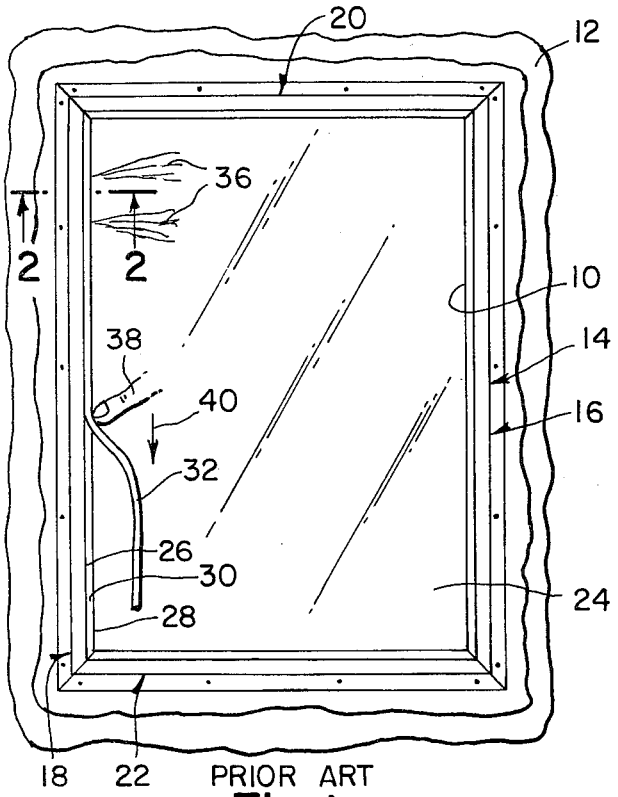
FIG. 1 is a front elevational view of an exemplary prior art combination mounting frame and plastic sheet that is typically used for storm window service in covering relation over a regular window, in which in addition to the structural features thereof it is illustrated how the plastic sheet is set into its cooperating mounting frame.
Figure 2:
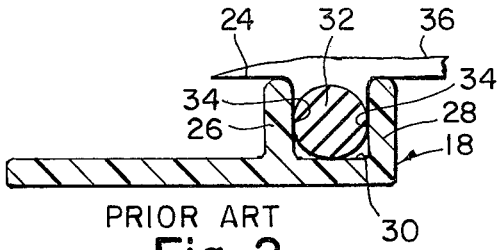
FIG. 2 is a side elevational view, on an enlarged scale and in section taken on line 2—2 of FIG. 1, illustrating further structural details thereof and, more particularly, illustrating one of the prior art shortcomings that manifests itself as wrinkles in the plastic sheet as a result of the inadequate performance of said illustrated structural features.

As background for, and to provide an understanding of the inventive contributions of the improved combination mounting frame and plastic sheet for a window according to the present invention, reference should first be made to the prior art counterpart thereof as illustrated in FIGS. 1 and 2. As understood, there is in wide use in conjunction with window openings 10 of a private dwelling 12, a "do-it-yourself" kit consisting of a supply length of a mounting strip, generally designated 14. In use, the supply length 14 is cut to appropriate sizes or strips 16, 18, 20 and 22, and appropriately mounted, by nails, screws or the like, in surrounding relation about the window opening 10. Next, and also as is well understood, a plastic sheet 24 is placed over the rectangular area delineated by the strips 16, 18, 20 and 22 and it is then the objective of the installer to mount the sheet 24 in a taut condition in the frame that is provided by the strips. To this end, and taking strip 18 as an illustration, the same as is perhaps best shown in FIG. 2 includes a pair of spaced apart upstanding walls 26 and 28 which bound a sheet-engaging channel 30 therebetween. An appropriate supply length of a round, elastomeric extrusion, generally designated 32, and in trade parlance known as a "spline", is used in the installation by being pressed into the channel 30 to thus frictionally engage the plastic sheet 24 against the internal surfaces of the walls 26 and 28, as at 34. One of the contributions of the present invention is the recognition that the above described conventional assembly procedure of attaching the plastic sheet to its supporting frame not only does not obviate the problems attendant to this procedure, but to a great extent contributes to these difficulties. Specifically, the use of a "round" spline 32 contributes to this member occasionally twisting during its insertion movement into the strip 18. As a result, and particularly when the direction of the twist is towards the window opening, the portion of the plastic sheet adjacent to the twisted spline is not subjected to an adequate stretching force and, in practice, therefore has been found to manifest undesirable wrinkles, designated 36 in the sheet 24, during mounting thereof in its supporting frame.

It is also to be noted, because it is also believed to contribute to said manifestation of wrinkles, that the specific manner in which the spline or sheet-engaging member is employed to frictionally engage the peripheral edges of the sheet is not conducive to obviating wrinkles. More particularly, as illustrated in FIG. 1, member 32 is usually started at a corner or other specific location, and is then progressively inserted in the channel 30, this progressive frictional engagement thereof in the channel 30 being signified by the diagrammatic illustration of the installer's finger 38 and the directional arrow 40. This is but another way of recognizing that the insertion of member 32 in channel 30 is not achieved entirely along the length of the channel in any one instance in time, but that the installation occurs from a starting point and with the installer sliding his hand or finger 38 in a direction 40 lengthwise of the particular mounting strip 18. It is believed that as a result of this requirement for a successive insertion of the member 30 or, more particularly, the application of force in the direction 40 that any excessive looseness in the plastic sheet 24 yields to the directional force 40 in such a way as to manifest itself as wrinkles 36 that extend or are oriented transversely of the direction 40. Although the plastic 24 is transparent, it should be obvious that the wrinkles 36 therein not only mar its appearance but adversely affect visibility through the window opening 10, and are therefore not desirable.

Not only is the typical prior art installation as illustrated in FIGS. 1, 2 and as described above characterized by an undesirable appearance due to wrinkles 36, but compounding the situation is the unsightliness in the selvage or the portion of the plastic sheet 24 that extends outwardly of the spline 32. To eliminate this unsightliness it is therefore necessary to trim away this selvage which, as may be readily appreciated, is a tedious task and often results in inadvertent marring of the mounting strip by the cutting implement used to remove the selvage.

Overcoming the above noted shortcomings of the prior art as well as providing other benefits and advantages, it is proposed according to the present invention to provide an optimum-shaped sheet-engaging member or spline that is characterized by significantly enhanced handling, particularly during the assembly of the sheet within its supporting frame and, of course, during disassembly thereof. Moreover, the noteworthy features of such spline which contribute to its ease of handling also effectively provide means for additionally stretching the plastic sheet during its frictional engagement in the sheet-engaging channel of the mounting strip means. As will be better understood as the description proceeds, such stretching forces as are applied to place the plastic sheet in a taut, wrinkle-free condition are of an optimum extent when using the particular configuration of the inventive spline illustrated in the drawings.

To some extent the improved combination mounting frame and film or plastic sheet hereof utilizes structural features already described in connection with the prior art structures of FIGS. 1, 2 and therefore, both for clarity and brevity sake, these same structural features are designated by the same but primed reference numerals already used in connection with the description of such features in FIGS. 1, 2, and only the additional structural features will be designated by unprimed consecutively numbered reference numerals. Thus, as is perhaps best illustrated in FIG. 4, the cross-sectional profile of the sheet-engaging strip means 18′ also includes upstanding walls 27′ and 28′ bounding channel 34′ therebetween.

Reference numeral 50 will be understood to identify a tape having a foam adhesive on its opposite surfaces, the same being used to attach the mounting strips in surrounding relation about the window opening 10′. Use of such double-adhesive tape facilitates the installation of the strips without tools and significantly broadens, by requiring adhesive attachment rather than attachment using nails, screws or other such connectors, the range of surfaces to which the strips can be readily attached. These surfaces, more particularly, can be of construction materials including glass, wood, plastic and metal. Moreover, the foam or cellular structure of the adhesive 50 effectively takes up any uneveness in the frame attachment surface. The effectiveness with which the attachment is achieved between strip 18 and the window frame 10′ also contributes to "air tightness" which, in an obvious manner, correspondingly contributes to the effective insulation of the window.

Considering next the mounting strip 18′, a significant structural addition thereto is the provision of an upstanding projection 52 extending centrally and lengthwise of the channel 34′, the function of which projection 52 will soon be readily understood. At the entrance into the channel 34', the upper inner edges of the walls 26' and 28' are also provided with spherical shapes 54 which, in an obvious manner, can be readily appreciated as facilitating the insertion movement of the spline into the channel 34'. Spherical shapes 54 are also effective in obviating any inadvertent removal of the spline since they in effect snap in place about the semi-circular or spherical shape of the spline, and thus exert a holding force thereon.

The significant structural changes over the prior art are embodied mainly in the spline or what is functionally the sheet-engaging member. Such member, designated 32', is preferably fabricated of a semi-rigid plastic as an extrusion. The cross-sectional profile, as best illustrated in FIGS. 5A, 5B, includes a semi-circular body 56 which has a centrally located longitudinally extending groove 58 formed therein, said groove being strategically located in facing relation and in alignment with the channel upstanding projection 52. Formed integral with body 56 is a transversely oriented leg 64 which in use assumes a horizontal orientation in spanning relation across the opening 60 into the channel 34'. Said horizontally oriented leg 64 thus contributes significantly to an improved functioning of the member 32' over the prior art spline in a number of ways. Among these improvements is the functioning thereof as a dust cover for the channel 34', to the extent that it extends across the opening thereof. Also, it functions as an easy finger grip, thereby greatly facilitating the ease in which it is handled during the assembly procedure. The installer, for example, is made to readily understand that member 32' is to be inserted until leg 64 contacts the upper portion or edges of the walls 26', 28'. Further, insofar as body 56 extends in depending relation from leg 64, these two components providing a T-shape in cross-section wherein body 56 enters the channel of the mounting strip in an essentially vertical orientation. Thus, there is no possibility of any twisting or similar movement in body 56 which could adversely affect the extent of frictional engagement between it and the plastic sheet or film 24'. Still further, the upper plane or flat surface of leg 64 functions in a manner which should be readily obvious to provide an enhanced "framed" appearance to the constructed assembly. Also, in the same way that leg 64 enhances the ease of insertion, it also functions as a finger grip to facilitate disassembly or removal from the strip 18' when, for example, it is desired to replace the film 24'. Still another improvement attributable to the leg 64 which is worth noting is that it is of an appropriate selected size to extend laterally on opposite sides in overhanging relation beyond the walls 26', 28'. As such, leg 64 contributes not only to an enhanced appearance in the mounting frame 14', as already noted, but it also permits the advantageous use of a razor or other appropriate cutting implement to be used in removing the excess selvage 64 in the plastic sheet 24 to the extent that removal is readily achieved along, or in the proximity of the cutting location 68 and is thus essentially masked from view by the overhang of leg 64.

Continuing with the assembly procedure, in the contemplated use of member 32' in conjunction with the cooperating channel 34', during installation of the plastic sheet 24', said sheet, or at least the peripheral edge thereof as illustrated in FIG. 5A, is placed in a strategic interposed position between the member 32' and the attached mounting strip 18'. As a result of initial insertion of member 32' within the strip 18', as illustrated in FIG. 5A, the plastic sheet 24 is initially engaged frictionally against the edges bounding the opening into the channel as at locations 60. Most important, the sheet 24' between the locations 60 is held reasonably taut across the bottom of the body 56 and is thus in a correspondingly taut condition, as at 62, in the portion which spans the opening of the groove 58. Next, and as may be readily appreciated by progressive examination of FIGS. 5A and 5B, the result of pushing the member 32' fully through its insertion movement into the strip 18' results in projection 52 being forced into groove 58 and consequently producing a partial wrap of the plastic sheet 24' about the projection 52. In conforming to the shape of projection 52, it should be readily appreciated that a force is thus imposed on the plastic sheet 24' which is effective in taking up any slack that may exist in the plastic sheet. At the very least, the force produced in the plastic sheet 24 just alluded to, prevents any slack from occurring therein and in this important way has been found in practice to significantly obviate any possibility of any wrinkles manifesting themselves in the sheet 24' during its installation within its supporting frame defined by the strips 16', 18', 20' and 22'.

A further aspect of improved performance noted in connection with the structurally modified spline or sheet-engaging member 32' of the present invention is that the centrally located groove 58 therein effectively delineates the body 56 thereof into two bifurcated legs 70 and 72. Although there is mainly yielding in the walls 26', 28' during the insertion movement of member 32' into channel 34', there is also a slight yielding movement in the legs 70 and 72 towards each other. This facilitates the body 56 effectively passing through the restricted opening bounded between the spherical entrance shapes 54 of channel 34'.

For completeness sake it is mentioned that film 24' is preferably a sheet of flexible plastic that is comparatively thin, generally from 0.0015 to 0.005 inches in gauge. It should have a slight ability to stretch and be as clear as possible, resistant to tearing, folding marks and to temperature differentials. Good results have been achieved using vinyl, polyester and polyethylene. In addition to being used with vinyl sheeting as hereinbefore described, the improved channel 18' and spline 32' can also be effectively used to frame appropriate web material that functions as a sun screen or block, or is tinted to control light transmission.

FIG. 6 illustrates another embodiment of the channel 18'. Since, as already noted, the construction material thereof is not elastomeric as was the case with the prior art channel 18', it may be desirable in some instances to provide member 18' with a capability of being rolled into a compact, storage condition. This condition is illustrated diagrammatically in FIG. 6 and denoted by the reference numeral 74. To enable member 18' to assume this condition despite its rigid construction material, after its extrusion it may advantageously be machine slotted as at spaced intervals 76. As a result, upstanding walls 26' and 28' will assume a coiled configuration by merely opening up at the spaced slots 76, in a well understood manner.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. Improvements for a frame attached about a window for holding a plastic sheet in a taut condition in covering relation over said window of the type employing mounting strip means in surrounding relation to said window consisting of spaced apart walls bounding a sheet-engaging channel therebetween and having a sheet-engaging member sized to be inserted into said channel incident to frictionally engaging said sheet against said walls, the improvements to said frame comprising a cooperating pair of interfitting projection and groove means for stretching said plastic sheet free of wrinkles during said insertion of said sheet-engaging member into said channel, said projection being centrally located in upstanding relation along said channel and said groove being formed in said sheet-engaging member in facing relation thereto, whereby the initial movement of said member into said channel frictionally engages said sheet against said walls thereof to provide a corresponding initially taut condition in said sheet and subsequent insertion movement thereof thereafter forces said projection into said groove with said sheet in an interposed position therebetween to cause the further stretching out of any wrinkles in said sheet.

2. An improved combination mounting frame and plastic sheet for attachment over a window as claimed in claim 1 wherein said groove is of an extent to provide bifurcated depending legs in said sheet-engaging member to contribute to slight inward movement of said legs towards each other during insertion movement of said member into said channel, to thereby facilitate said insertion movement.

3. An improved combination mounting frame and plastic sheet for attachment over a window as claimed in claim 2 wherein attached to said bifurcated depending legs of said sheet-engaging member is a transversely oriented leg sized to extend laterally on opposite sides of said walls of said channel, whereby said overhang of said leg laterally beyond said channel walls effectively masks the presence of said walls to thereby contribute to an enhanced appearance in said mounting frame.

4. An improved combination mounting frame and plastic sheet for attachment over a window as claimed in claim 3 wherein said spaced apart walls providing said sheet-engaging channel is transversely slotted at spaced intervals therealong to enable the placement thereof into a rolled, compact storage condition.

5. An improved combination mounting frame and plastic sheet as claimed in claim 4 wherein said plastic sheet is preferably vinyl.

6. An improved combination mounting frame and plastic sheet as claimed in claim 5 including an adhesive applied to said mounting strip means to correspondingly contribute to adhesive attachment thereof in said surrounding relation to said window.

* * * * *